US006209708B1

(12) United States Patent
Philipp et al.

(10) Patent No.: US 6,209,708 B1
(45) Date of Patent: Apr. 3, 2001

(54) CONVEYOR SYSTEM FOR RECEIVING, ORIENTING AND CONVEYING POUCHES

(76) Inventors: Timothy L. Philipp, 2517 W. Burr Oak Ct., Sarasota, FL (US) 34232; Bruce A. Naylor, 6306 36$^{th}$ Ave. West, Bradenton, FL (US) 34209; Joseph F. Kolcun, 1714-1/2 W. Hills Rd., Tampa, FL (US) 33606

( * ) Notice: Subject to any disclaimer, the term of this patent is extended or adjusted under 35 U.S.C. 154(b) by 0 days.

(21) Appl. No.: 09/366,413

(22) Filed: Aug. 4, 1999

(51) Int. Cl.$^{7}$ ..... B65G 37/00

(52) U.S. Cl. ..... 198/465.1; 198/867.12; 198/867.14; 141/166; 141/179; 141/237; 141/316; 53/459; 53/564; 53/570

(58) Field of Search ..... 198/465.1, 867.14, 198/867.12; 141/166, 179, 237, 316; 53/459, 564, 570

(56) References Cited

U.S. PATENT DOCUMENTS 4,267,918 * 5/1981 Steinbrecher ..... 198/465.1
4,473,989 * 10/1984 Tsutsumi et al. ..... 198/465.1

* cited by examiner

*Primary Examiner*—Joseph E. Valenza

(57) ABSTRACT

A conveyer system for receiving, orienting and conveying pouches is disclosed. The conveyor system includes a plurality of pucks, each puck having a lower extent with a recess extending upwardly from the lower surface thereof and having an upstanding cylindrical wall. An indexing conveyer includes a belt in a closed loop configuration supported by an idler roller at one end and with a drive roller at the other end with a motor to drive the rollers and belt in a step and repeat operation. The exterior surface of the belt is formed with a plurality of plates with a cleat on each plate to receive the recesses of a plurality of pucks thereacross. An infeed conveyer has a spine alignable with the cleat at the input end of the indexing conveyor adapted to receive and orient pucks from the infeed conveyer to the indexing conveyer. The infeed conveyer has an input end and an output end, the output end being located adjacent to the input end of the indexing conveyer. The infeed conveyor includes a belt in a closed loop configuration supported by an idler roller at one end and a drive roller at the other end with a motor to drive the rollers and belt and pucks thereabove to the indexing conveyor. Lastly, a filler exit conveyor has an input end and an output end, the input end being located in operative proximity to the output end of the indexing conveyor. The filler exit conveyor includes a conveyor belt supported by an idler roller and a drive roller with a motor to drive the rollers and belt.

5 Claims, 5 Drawing Sheets

CONVEYOR SYSTEM FOR RECEIVING, ORIENTING AND CONVEYING POUCHES

BACKGROUND OF THE INVENTION

1. Field of the Invention

The present invention relates to a new and improved conveyor system for receiving, orienting and conveying pouches and, more particularly, pertains to receiving, orienting and conveying pouches adapted to receive fluid material therein.

2. Description of the Prior Art

The use of conveyors of known designs and configurations is known in the prior art. More specifically, conveyors of known designs and configurations heretofore devised and utilized for the purpose of receiving objects, orienting objects and conveying objects through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,060,782 to Marti discloses an automatic machine for positioning and feeding flat containers. U.S. Pat. No. 5,853,077 to Schmitt discloses an article handling device combination and method. U.S. Pat. No. 4,171,738 to Lieberman discloses a conveyor mechanism for conveying flexible pouches adapted to contain fluids, granular substances and the like. U.S. Pat. No. 3,778,972 to Chilipalski discloses an apparatus for handling liquid filled flexible pouches. U.S. Pat. No. 4,660,353 to Greenwell discloses an intermittent motion cartoning apparatus for cartoning liquid-filled pouches. U.S. Pat. No. 5,187,917 to Mykleby discloses an automatic packaging apparatus and method and flexible pouch therefor. Finally, U.S. Pat. No. 4,696,145 to Schmidt et al. discloses an automatic container stuffing apparatus and method.

In this respect, the conveyor system for receiving, orienting and conveying pouches according to the present invention substantially departs from the conventional concepts and designs of the prior art, and in doing so provides an apparatus primarily developed for the purpose of receiving, orienting and conveying pouches adapted to receive fluid material therein.

Therefore, it can be appreciated that there exists a continuing need for a new and improved conveyor system for receiving, orienting and conveying pouches which can be used for receiving, orienting and conveying pouches adapted to receive fluid material therein. In this regard, the present invention substantially fulfills this need.

SUMMARY OF THE INVENTION

In view of the foregoing disadvantages inherent in the known types of conveyors of known designs and configurations now present in the prior art, the present invention provides a new and improved conveyor system for receiving, orienting and conveying pouches. As such, the general purpose of the present invention, which will be described subsequently in greater detail, is to provide a new and improved conveyor system for receiving, orienting and conveying pouches and methods which have all the advantages of the prior art and none of the disadvantages.

To attain this, the present invention essentially comprises a new and improved conveyer system for receiving, orienting and conveying pouches adapted to receive fluid material therein comprising, in combination, a plurality of pucks, each puck having a cylindrical lower extent with a rectangular recess extending upwardly from the lower surface thereof and extending across the entire diameter thereof and having an upstanding cylindrical wall with generally V-shaped openings formed therein for receiving and supporting a pouch; a powered indexing conveyer including a belt in a closed loop configuration supported by an idler roller at one end and with a drive roller at the other end with a motor to drive the rollers and belt in a step and repeat operation, the exterior surface of the belt being formed with a plurality of spaced plates extending transversely thereacross with an upstanding rectilinear cleat on each plate to receive the recesses of a set of four pucks thereacross, the indexing conveyer belt being in a generally horizontal orientation with an input end and an output end; a powered infeed conveyer having a generally horizontal spine alignable with the cleat at the input end of the indexing conveyor adapted to receive and orient pucks from the infeed conveyer to the indexing conveyer and with an overhead guide rail located immediately above the upper edge of the pucks to preclude tipping of the pucks, the infeed conveyer having an input end and an output end adjacent to the input end of the indexing conveyer with an escapement mechanism therebetween to control the quantity of pucks transferred from the infeed conveyer to the indexing conveyor, the infeed conveyor including a belt in a closed loop configuration supported by an idler roller at one end and a drive roller at the other end with a motor to drive the rollers and belt and pucks thereabove in a horizontal path of movement to the indexing conveyor; a filler infeed chute having an elevated input end and a lower output end adjacent to the input end of the infeed conveyor and with a lower spine to receive and orient pucks as they are fed by gravity down the infeed chute, the infeed chute also having an overhead rail located immediately above the upper edge of the pucks to preclude the tipping thereof; a filler exit conveyor having an input end and an output end, the input end being located in operative proximity to the output end of the indexing conveyor, the filler exit conveyor including a conveyor belt supported by an idler roller and a drive roller with a motor to drive the rollers and belt, the rollers of the exit conveyor being mounted for rotation about the vertical axes with the belt having a vertical path of travel adjacent to the pucks at the output end of the indexing conveyor, the conveyor belt having a plurality of outwardly extending fingers adapted to contact and move the set of four pucks at the output end of the indexing conveyor and to move them to the input end of the exit conveyor; feeding mechanisms located over the indexing conveyor adapted to deliver sets of four pouches downwardly into the recesses within a set of pucks laterally aligned on the indexing conveyor; and control mechanisms to operate the motors in a continuous and automatic cycle of operation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved conveyor system for receiving, orienting and conveying pouches which has all the advantages of the prior art conveyors of known designs and configurations and none of the disadvantages.

It is another object of the present invention to provide a new and improved conveyor system for receiving, orienting and conveying pouches which may be easily and efficiently manufactured and marketed.

It is a further object of the present invention to provide a new and improved conveyor system for receiving, orienting and conveying pouches which is of a durable and reliable construction.

An even further object of the present invention is to provide a new and improved conveyor system for receiving, orienting and conveying pouches which is susceptible of a low cost of manufacture with regard to both materials and labor, and which accordingly is then susceptible of low prices of sale to the consuming public, thereby making such a conveyor system for receiving, orienting and conveying pouches economically available to the buying public.

Even still another object of the present invention is to receive, orient and convey pouches adapted to receive fluid material therein.

Lastly, it is an object of the present invention to provide a conveyer system for receiving, orienting and conveying pouches. The conveyor system includes a plurality of pucks, each puck having a lower extent with a recess extending upwardly from the lower surface thereof and having an upstanding cylindrical wall. An indexing conveyer includes a belt in a closed loop configuration supported by an idler roller at one end and with a drive roller at the other end with a motor to drive the rollers and belt in a step and repeat operation. The exterior surface of the belt is formed with a plurality of plates with a cleat on each plate to receive the recesses of a plurality of pucks thereacross. An infeed conveyer has a spine alignable with the cleat at the input end of the indexing conveyor adapted to receive and orient pucks from the infeed conveyer to the indexing conveyer. The infeed conveyer has an input end and an output end, the output end being located adjacent to the input end of the indexing conveyer. The infeed conveyor includes a belt in a closed loop configuration supported by an idler roller at one end and a drive roller at the other end with a motor to drive the rollers and belt and pucks thereabove to the indexing conveyor. Lastly, a filler exit conveyor has an input end and an output end, the input end being located in operative proximity to the output end of the indexing conveyor. The filler exit conveyor includes a conveyor belt supported by an idler roller and a drive roller with a motor to drive the rollers and belt.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
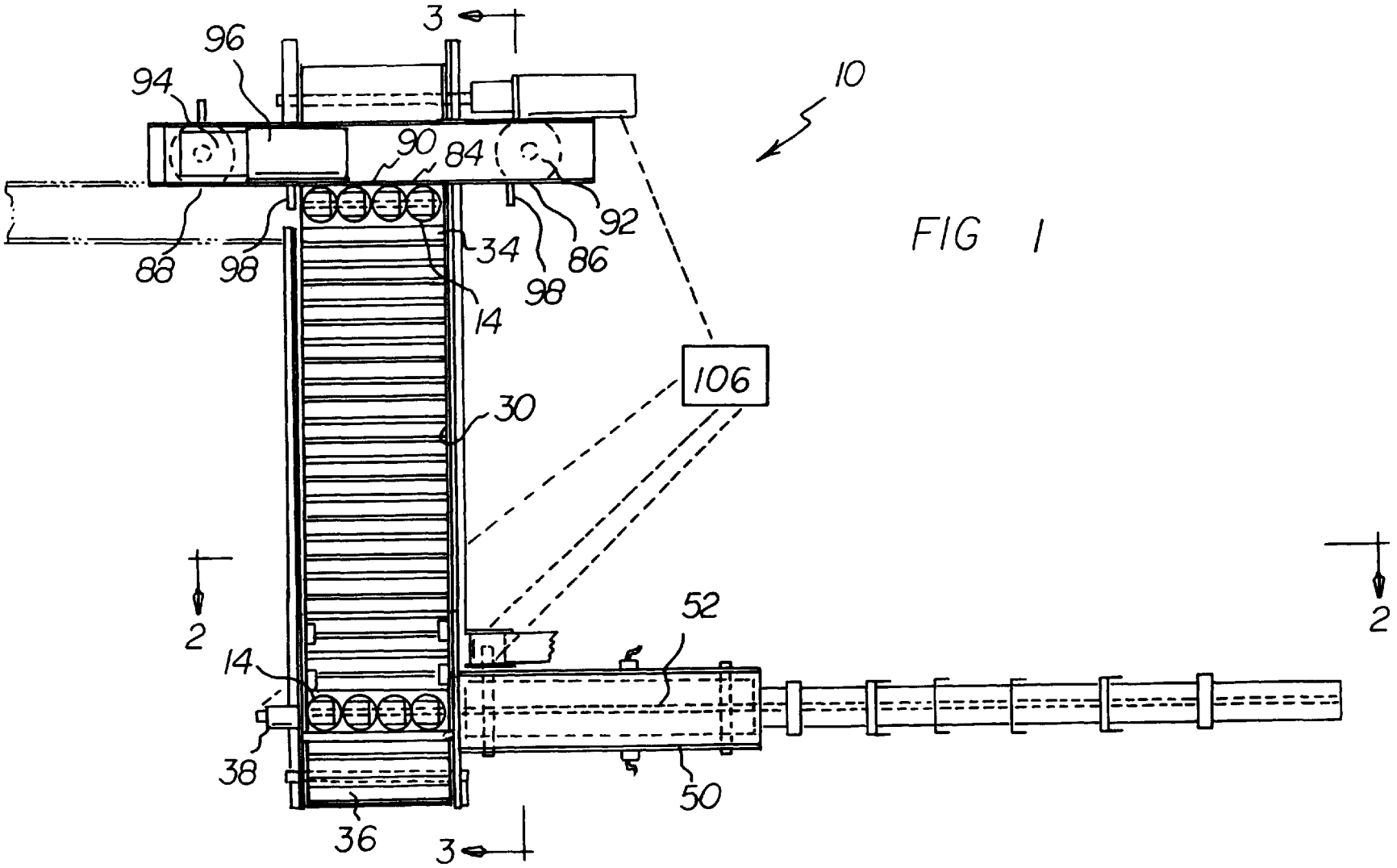
FIG. 1 is a top elevational view of the new and improved conveyor system for receiving, orienting and conveying pouches constructed in accordance with the principles of the present invention.
Figure 2:
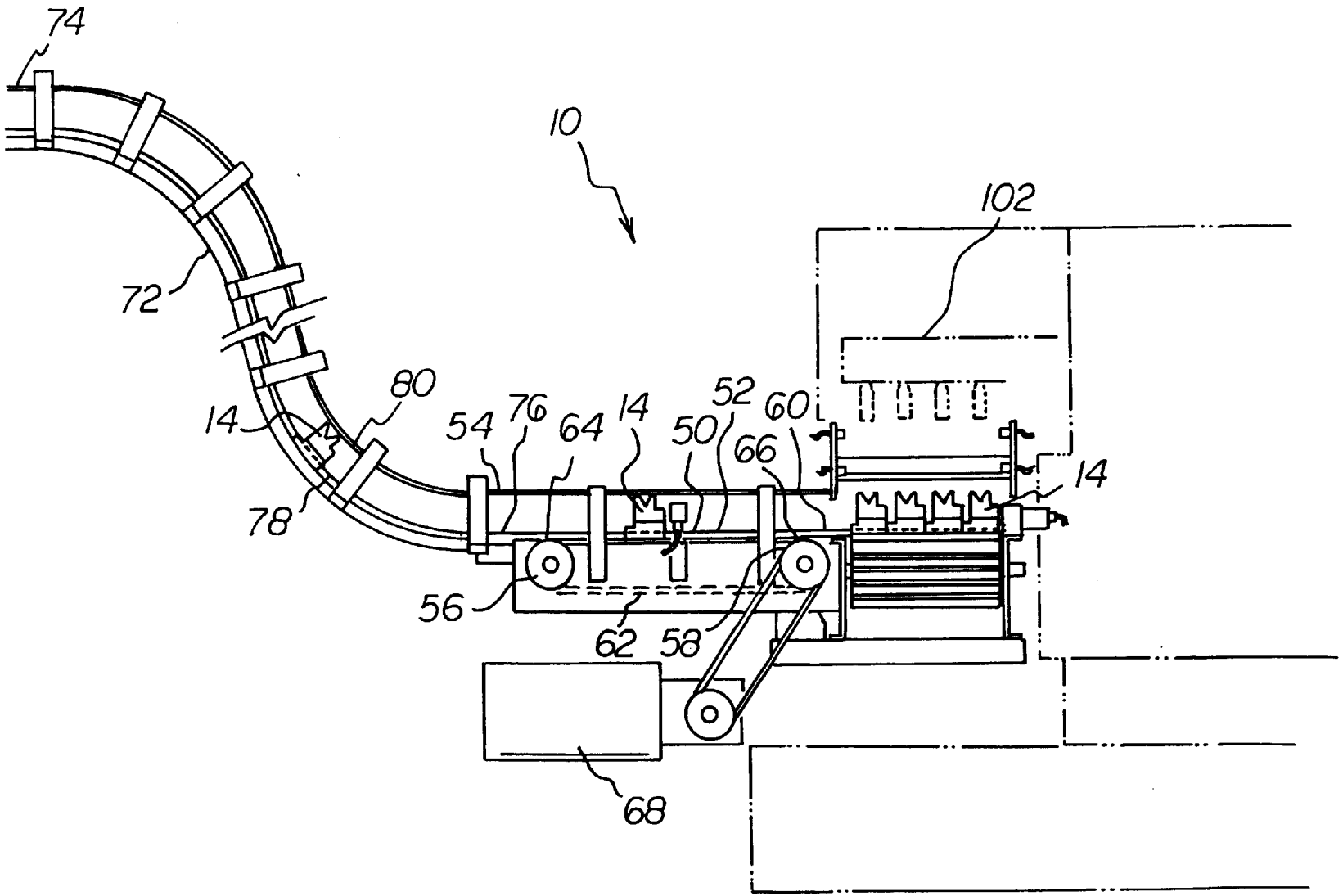
FIG. 2 is a cross-sectional view taken along line 2—2 of FIG. 1.
Figure 3:
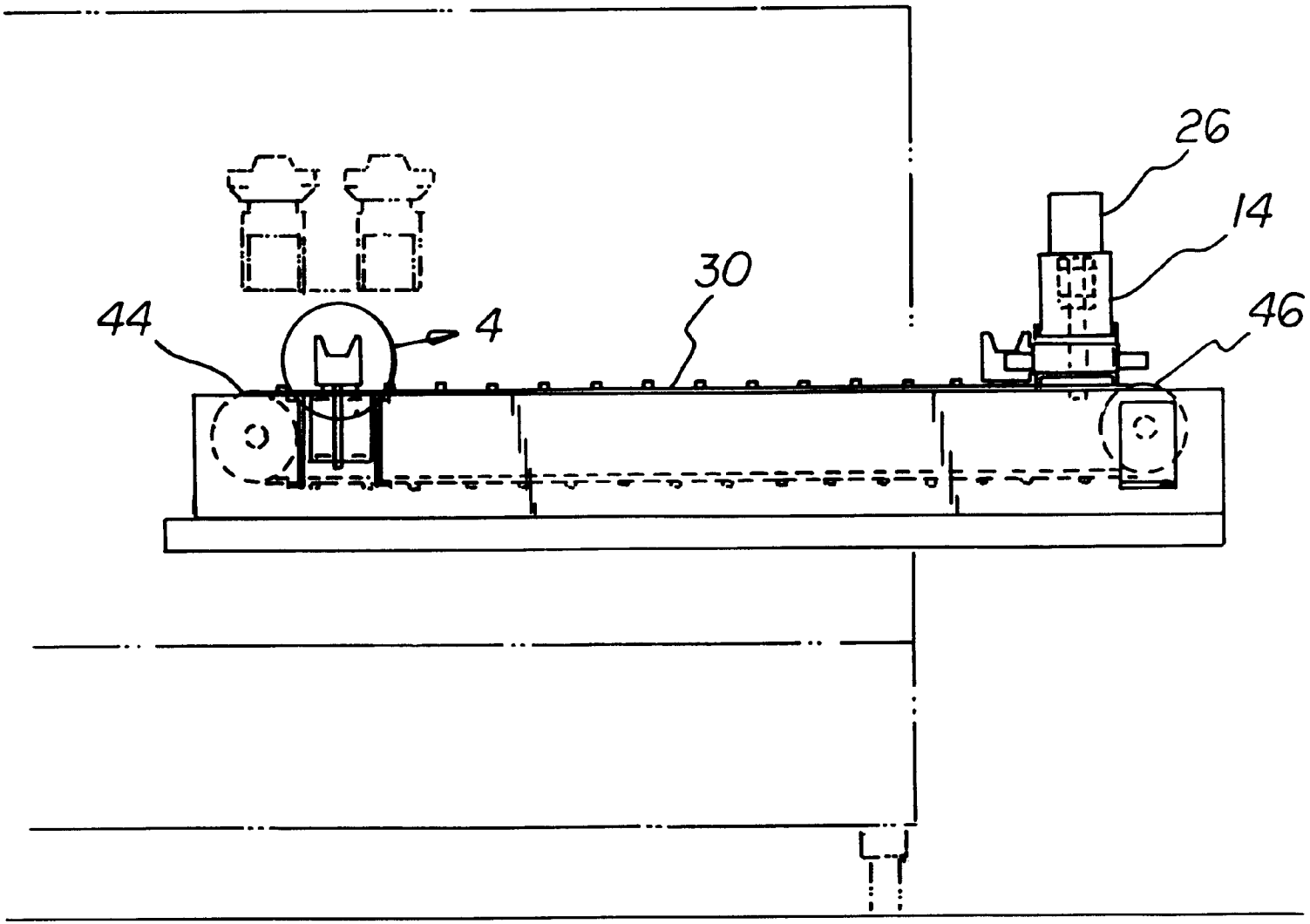
FIG. 3 is a cross-sectional view taken along line 3—3 of FIG. 1.
Figure 5:
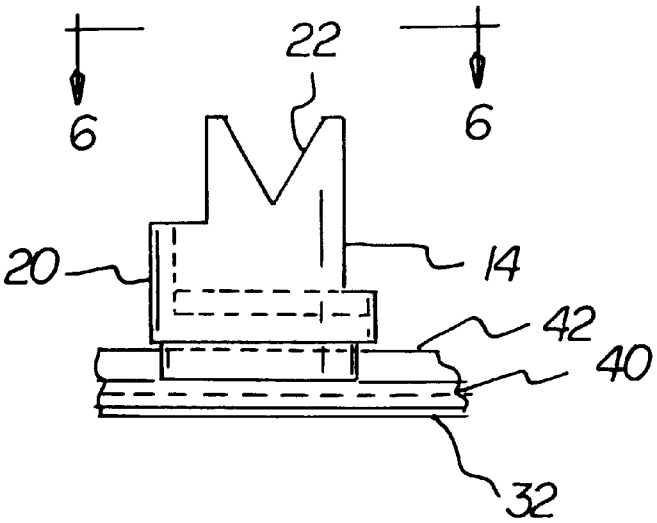
FIG. 5 is a cross-sectional view taken along line 5—5 of FIG. 4.
Figure 4:
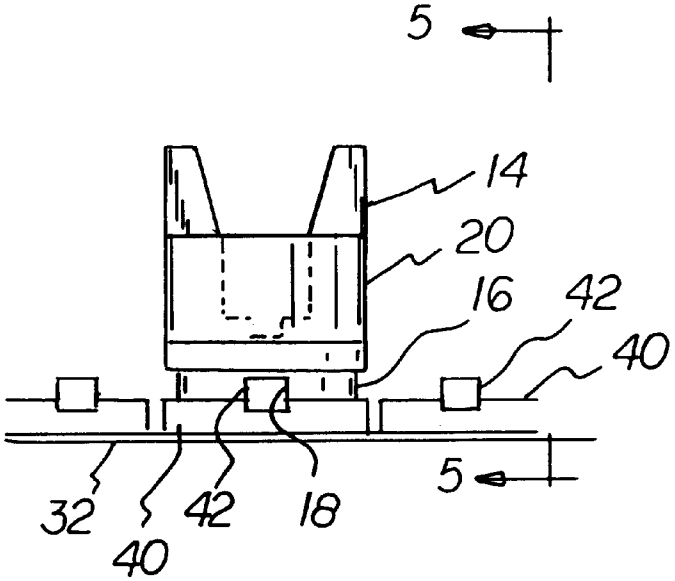
FIG. 4 is a side elevational view of one of the pucks of the present invention.
Figure 6:
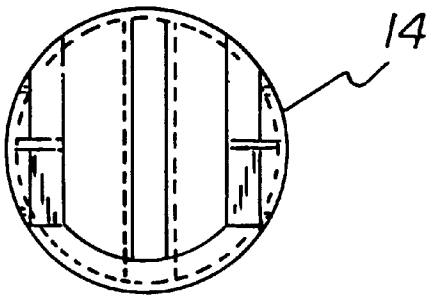
FIG. 6 is a cross-sectional view taken along line 6—6 of FIG. 5.

With reference now to the drawings, and in particular to FIGS. 1 through 7 thereof, the preferred embodiment of the new and improved conveyor system for receiving, orienting and conveying pouches embodying the principles and concepts of the present invention and generally designated by the reference numeral 10 will be described.

The present invention, the new and improved conveyor system for receiving, orienting and conveying pouches, is a system 10 comprised of a plurality of components. Such components, in their broadest context, include a plurality of pucks, a powered indexing conveyor, a powered infeed conveyor, a filler infeed chute, a filler exit conveyor, feeding mechanisms and control mechanisms. Each of the individual components is specifically configured and correlated one with respect to the other so as to attain the desired objectives.

The conveyer system 10 includes a plurality of pucks 14. Each puck has a cylindrical lower extent 16 with a rectangular recess 18. The rectangular recess extends upwardly from the lower surface thereof and extends across the entire diameter thereof. The rectangular recess further has an upstanding cylindrical wall 20 with generally V-shaped openings 22 formed therein, extending downwardly from the upper edge at diametrically opposed locations, for receiving and supporting a pouch 26.

The pouch to puck interface at the filler consists of a filler infeed chute, a powered infeed conveyor, a filler indexing conveyor and a filler exit conveyor. The relationship of these components is as follows; (a) The filler infeed chute is responsible for providing the powered infeed conveyor with an uninterrupted supply of pucks; (b) The powered infeed conveyor is responsible for driving a predetermined mixed plurality, preferably four pucks, onto the filler indexing conveyor; (c) The filler indexing conveyor is responsible for moving the pucks to a precise location under the filler discharge station and to present the pucks to the filler exit conveyor; and (d) The filler exit conveyor is responsible for removing the pucks from the filler indexing conveyor.

The design of the pouch to puck interface has been centered on two key elements. The first element relates to the duty cycle and the second relates to the environment. The pouch to puck interface has been designed to operate 24 hours a day, 7 days a week, 52 weeks a year with minimal maintenance. The pouch to puck interface has also been designed to operate in a harsh wash down environment.

The powered, or filler, indexing conveyor 30 includes a belt 32 in a closed loop configuration supported by an idler roller 34 at one end and with a drive roller 36 at the other end with a motor 38 to drive the rollers and belt in a step and repeat operation. The exterior surface of the belt is formed with a plurality of spaced plates 40 extending transversely thereacross. Each plate is formed with an upstanding rectilinear cleat 42 to receive the recesses of a set of four pucks thereacross. The indexing conveyer belt is located in a generally horizontal orientation with an input end 44 and an output end 46.

The powered, or filler, indexing conveyor is configured to accept pucks from the powered infeed conveyor. As the pucks enter the filler indexing conveyor, they will be driven across a small dead plate by the powered infeed conveyor. The filler indexing conveyor will transfer the pucks four wide to the filler pouch discharge station. The index distance for this transfer will be in 90 mm increments. Pouches will be dropped into the pucks at the filler pouch discharge station. From there, the powered, or filler, indexing conveyor will transfer the pucks with pouches to the filler exit conveyor. Conveyor elevation measured from the floor to the bottom of the puck is 36 inches.

The pucks will maintain orientation in the power, or filler, indexing conveyor by the use of multiple cleats on the belt similar in size to the central spine of the filler infeed chute. The cleats on the belt are made of urethane that is molded directly to the timing belt and set at 90 mm increments. Side rails on the filler indexing conveyor will prevent the pucks from moving along the orientation cleats. A slider bed located under the urethane timing belt will provide the belt and pucks with support.

The power, or filler, indexing conveyor will be constructed from the following materials: conveyor side plates, side plate spacers, drive and idler shafts, puck side guide mounting rails, support legs, support frame, pouch reject chute, and all hardware will be fabricated of stainless steel type 304. The timing belt slider bed and puck side guides are fabricated of high weight plastic. The drive and idler sprockets are fabricated of hard coat anodized aluminum. The timing belts, 10 mm pitch, self tracking, and molded cleat are fabricated of urethane. The bearings will be fabricated of Valu Guide "LifeGard".

The powered infeed conveyor 50 has a generally horizontal spine 52 alignable with the cleat at the input end of the indexing conveyor. The cleat is adapted to receive and orient pucks from the infeed conveyer to the indexing conveyer. Also provided is an overhead guide rail 54 located immediately above the upper edge of the pucks to preclude tipping of the pucks. The infeed conveyer has an input end 56 and an output end 58 adjacent to the input end of the indexing conveyer with an escapement mechanism 60 therebetween to control the quantity of pucks transferred from the infeed conveyer to the indexing conveyor. The infeed conveyor further includes a belt 62 in a closed loop configuration supported by an idler roller 64 at one end and a drive roller 66 at the other end with a motor 68 to drive the rollers and belt and pucks thereabove in a horizontal path of movement to the indexing conveyor.

Figure 7:
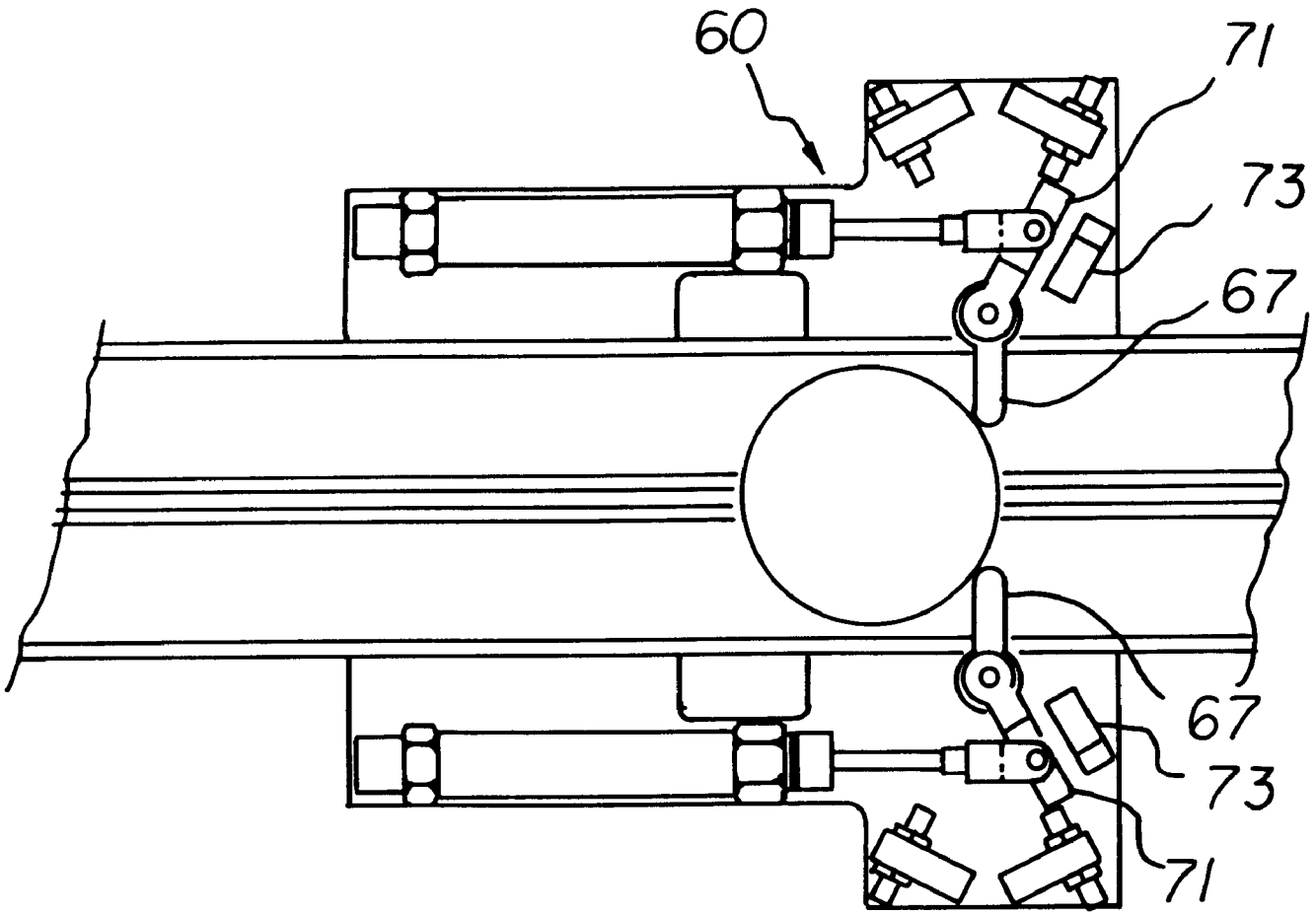
FIG. 7 is a top elevational view of the escapement mechanism.

The escapement mechanism is generally noted by numeral 60. The mechanism includes fingers or gates 67 on opposite sides of the path of travel. The fingers or gates are pivotally mounted between a first position as shown in FIG. 7 wherein the movement of the pucks is stopped and an open position wherein the pucks may be fed therethrough. Movement of the fingers between the opened and closed positions is effected by the gate cylinders operated in timed sequence by the computer system. The sides 71 of the fingers remote from the puck are coupled to the piston of the cylinder to effect the opening and closing of the escapement mechanism. On such side of the fingers remote from the puck there are a pair of proximity sensors on each side of the path of travel. One proximity sensor determines when the gate is open. The other when the gate is closed. In addition, there is a hard stop 73 for the gates to preclude improper extended motion of the fingers or gates.

The powered infeed conveyor is a transition between the exit of the filler infeed chute and the entrance to the filler indexing conveyor. Pucks exiting the filler infeed chute will travel across a small dead plate before entering the powered infeed conveyor. The pucks will be driven across the dead plate using the pressure generated by the residual pucks in the filler infeed chute. An escapement device located at the exit of the powered infeed conveyor will control the transfer of pucks onto the indexing conveyor. Conveyor elevation measured from the floor to the bottom of the puck is 36 inches.

The powered infeed chute has a central spine similar to the filler infeed chute and is used to maintain puck orientation. A urethane timing belt on either side of the spine will provide the required drive pressure on the bottom of the puck. A common sprocket will drive both timing belts and the length of these belts will accommodate up to eight pucks. The top rail feature on the infeed chute will continue across the powered infeed conveyor to help guide the pucks.

The exit side of the powered infeed conveyor will have an escapement device. The escapement device will be timed to the motion profile of the filler indexing conveyor and will control the quantity of pucks being transferred. The escapement device will also relieve any pressure to the pucks on the powered infeed conveyor generated by the residual pucks on the powered infeed conveyor.

The powered infeed conveyor will be constructed from the following materials: Conveyor side plates, side plate spacers, drive and idler shafts, overhead rail brackets, conveyor legs, and all hardware will be fabricated of stainless steel type 304. The top rail, central spine, timing belt slider bed, dead plates, and escapement fingers will be fabricated of high weight plastic. The drive and idler sprockets will be fabricated of hard coat anodized aluminum. The timing belts are 10 mm pitch, self-tracking and will be fabricated of urethane. The bearings will be fabricated of Valu Guide "LifeGard".

The next component of the system is a filler infeed chute 72. The filler infeed chute 72 has an elevated input end 74 and a lower output end 76 adjacent to the input end of the infeed conveyor. It is further provided with a lower spine 78 to receive and orient pucks as they are fed by gravity down the infeed chute. In addition, the infeed chute also has an overhead rail 80 located immediately above the upper edge of the pucks to preclude the tipping thereof.

The filler infeed chute will accept pucks oriented in single file from an accumulation conveyor. The input to the chute will be at an elevation of 108 inches measured from the floor to the bottom of the puck. The pucks will be driven across a small dead plate by the accumulation conveyor and enter the infeed chute. The pucks will travel down a 75 degree incline and exit the chute at an elevation of 36 inches. The puck feed rate in the chute will be controlled by gravity and the pressure developed by the accumulation conveyor.

The filler infeed chute has a central spine that controls the orientation of the pucks using the slot feature centered in the base of the puck. The base of the puck will be supported on both sides of the spine by wear strips. A top rail will help guide the pucks and prevent them from tipping forward in the chute. The filler infeed chute will mount directly to the exit of the accumulation conveyor and to the entrance of the powered infeed conveyor. The chute will be rigid enough to require no other supporting structures. An escapement prior to the chute may be necessary to control the feed pressure of the pucks in the chute.

The filler infeed chute will be constructed from the following materials: central spine, overhead rail brackets, overhead rail spacers, wear strip supports and all hardware will be fabricated of stainless steel type 304. The top rail and wear strips will be fabricated of high weight plastic.

The filler exit conveyor 84 has an input end 86 and an output end 88. The input end is located in operative proximity to the output end of the indexing conveyor. The filler exit conveyor includes a conveyor belt 90 supported by an idler roller 92 and a drive roller 94 with a motor 96 to drive the rollers and belt. The rollers of the exit conveyor are mounted for rotation about the vertical axes with the belt and have a vertical path of travel adjacent to the pucks at the output end of the indexing conveyor. The conveyor belt has a plurality of outwardly extending fingers 98 adapted to contact and move the set of four pucks at the output end of the indexing conveyor and to move them to the input end of the exit conveyor.

The filler exit conveyor will accept pucks from the filler indexing conveyor and transfer them to the take away conveyor. During the dwell period of the filler indexing conveyor, the filler exit conveyor will drive the pucks off of the cleat using a pusher.

The filler exit conveyor will be orientated perpendicular to the filler indexing conveyor and rotated 90 degrees on its side. The pusher will accelerate the four pucks during the entire filler indexing conveyors dwell period and decelerate returning to the home position during the filler indexing conveyors index period. The urethane timing belt will have four urethane pushers molded directly to the belt.

The filler exit conveyor will be constructed from the following materials: Conveyor side plates, side plate spacers, drive and idler shafts, and all hardware will be fabricated of stainless steel type 304. The timing belt slider bed will be fabricated of high weight plastic. The drive and idler sprockets will be fabricated of hard coat anodized aluminum. The timing belts, 10 mm pitch, self tracking, and molded pusher will be fabricated of urethane. The bearings will be fabricated of Valu Guide "LifeGard".

Further provided as a component of the system are feeding mechanisms 102. The feeding mechanisms are located over the indexing conveyor. They are adapted to deliver sets of four pouches downwardly into the recesses within a set of pucks laterally aligned on the indexing conveyor.

Lastly provided as a component of the system are control mechanisms 106 to operate the motors in a continuous and automatic cycle of operation.

Control System Overview

The Boomerang Filler Feed System consists primarily of five component groups:

1. Puck Chute,
2. Powered Infeed Conveyor,
3. Lower Puck Stop Gate,
4. Flighted Indexing Conveyor,
5. Puck Exit Transfer Sweep.

The Puck Chute will accept pucks from an upper level Main Infeed conveyor. (A Stop Gate can be located before the puck chute will hold back the pucks on the Main Infeed conveyor to limit the load pressure in the Puck Chute.)

The force generated by the conveyor will "prime" the chute, pushing pucks onto the chute dead plate, down the throat of the chute, and onto a Powered Infeed Conveyor.

The VFD controlled Powered Infeed conveyor will include an escapement or Lower Puck Stop Gate that ensures the proper number of pucks enter onto the Flighted Indexing conveyor. A puck dampener will be used to absorb the impact of the empty pucks entering onto the Flighted Indexing Conveyor from the Powered Infeed conveyor.

The Flighted Indexing conveyor will index based on presence of product from the filler machine and their release into the staged pucks.

The position that the pucks are staged for receiving product will coincide with the position where the pucks can be fed onto the indexing conveyor and the position where the filled pucks are removed from the indexing conveyor by the Puck Exit Transfer Sweep. Empty pucks will be transferred onto the indexing conveyor simultaneous to the loaded pucks being transferred off.

A PLC will control the starting and stopping of this system, machine mode of operation, operator display, system monitoring and with external systems.

The Servo Motion Controllers will monitor and control the High Speed events sequences within the machine cycle.

General Sequence of Events

0. In order for the bossar filler and the filler feed system to operate in a continuously running mode:
   a) The main infeed conveyor must be ready and running. (upstream)
   b) There must be pucks available on the main infeed conveyor (upstream)
   c) The flighted indexing conveyor must be homed (infeed homed)
   d) The puck exit transfer sweep must be homed (infeed homed)
   e) There must be pucks primed in the puck chute. (infeed primed)
   f) Pucks must be indexed to the puck load position. (infeed primed)
   g) The exit takeaway conveyor must be ready and running. (down stream)
1. Pucks flow, in a single, consistently oriented line down a main infeed conveyor, down the puck chute onto the powered infeed conveyor. (An upper stop gate can inhibit the flow of pucks into the puck chute.)
2. The puck chute is primed when Pucks have entered the system and the chute prime sensor has indicates that pucks have been accumulated in the chute. The puck chute is not primed when the chute prime sensor has not detected pucks for a period of time.

3. The flighted indexing conveyor will be positioned and the puck dampener will be extended and ready to accept the empty pucks.
4. When the lower stop gate receives a signal to open only if there were pouches previously detected, the pneumatic device forces the gate open allowing the powered infeed conveyor to transfer pucks to the flighted indexing conveyor. The puck dampener will absorb the impact of the empty pucks entering onto the flighted indexing conveyor.
5. Puck counting sensors will register that four (4) pucks have been transferred to the flighted indexing conveyor.
6. In response to the puck counting sensors registering the forth puck, the lower stop gate will receive a signal to close.
7. Empty pucks will be positioned to receive pouches. The filler feed system will wait for the bossar filler to release the pouches into the pucks. A signal from the bossar filler will be used to indicate that the pouches have dropped into the pucks. The conditions that must be met before the flighted indexing conveyor will index will be:
   a) The lower stop gate must be closed.
   b) Pouches must be settled in the pucks.
   c) The puck exit transfer sweep must be clear of the flighted indexing conveyor.
8. The flighted indexing conveyor will index 100 mm to the next puck load position. This position will also correspond to the position that pucks can be transferred onto and off of the flighted indexing conveyor. After the index is complete, front and rear puck sensors will check to verify that pouches are not hanging out of the puck. Too many consecutive instances of pouch out of puck will generate a fault.
9. Once the flighted indexing conveyor has completed its index move, the signal will be sent to open the lower stop gate, the signal will be sent to extend the puck dampener, and a signal will be sent to begin a puck exit transfer.
10. When the puck exit transfer sweep receives a signal to transfer the pucks, it will accelerate the filled pucks off of the flighted indexing conveyor onto an Exit takeaway conveyor, a total of 500 mm. It will then signal that it is clear of the flighted indexing conveyor.

This cycle (steps 3–10) will continue as the normal running operation of the system.

Programmable Logic Controller (PLC)

The system programmable logic controller is the central device for providing control and communication connectivity. The PLC is an Allen-Bradley SLC 504 with DH+, programmed with the Rockwell Software RS500 application development software. The PLC will be capable of communication with the Servo Drives over channel 0, the RS232 port.

The PLC informs the Servo System what mode is required based on ESTOP status, Auto/Manual switch selection and Ready/Not Ready status detected from discrete inputs. A listing of the system information transfer refer to the Servo section in this document. The PLC also will monitor for faults from the Servo Drives as well as other faults including the VFD drive, Pouch Tilt and Backwards Pucks. A complete listing of faults and status messages can be found in the Operator Display section in this document.

The PLC is equipped with the Allen-Bradley Data Highway Plus (DH+) communication protocol. The Filler Feeder will communicate to the filler and the GEBO conveyor system through the DH+port.

Operator Display

The operator message display is an Allen Bradley DL5 that communicates with the PLC via discrete signals that select a message. The message display will indicate fault descriptions. Servo Controllers The Servo Controllers will be Pacific Scientific SC902 Series High Performance Digital Servo Drives, with OC950 Programmable Single Axis Position Control Option Cards, and programmed using Pacific Scientific's 950BASIC. The Drives will communicate and synchronize via PacLAN communication interface at 2.5 Mbaud. The Drives will be capable of communication with the PLC over an RS232 Channel. An incremental encoder can be used to synchronize the feed system with the bossar equipment.

The Servo and PLC communicate to each other over RS232 connectivity and transmit integer codes that translate into current operational steps or sequences, status codes, and fault codes. The Servo writes this task list data to the PLC into Data Files N31 using Pacific Scientifics ABCOMM protocol. The current operation or step the Servo is operating on is written to N31:0. The following table indicates the integer codes that are communicated from the Servo System to the PLC into N31:0.

TABLE 1

Servo Current Task List

| Value | Description |
|---|---|
| 100 | Program Not Running |
| 110 | Program Running |
| 120 | Servo Faulted |
| 200 | Servo Not Enabled |
| 210 | Servo Enabled |
| 220 | |
| 300 | Not Homed |
| 310 | Servo Homing |
| 320 | Servo Homing Complete |
| 400 | Not Primed |
| 410 | Servo Priming |
| 420 | Servo Prime Complete |
| 500 | Servo Ready |
| 510 | Servo Running |
| 520 | Servo Stopping |
| 600 | Filler Feeder Purging |
| 610 | Filler Feeder Purge Complete |

The PLC informs the Servo System what mode is required based on Auto Manual switch selection and Ready Not Ready status detected from discrete inputs. The current operation or step the Servo should be operating on is written to N7:0. The following table indicates the integer codes that are communicated from the PLC to the Servo System into N7:0.

TABLE 2

PLC Command Task List

| Value | Description |
|---|---|
| 0 | Filler Feeder in ESTOP |
| 10 | Filler Feeder ESTOP Ready to clear |
| 20 | Filler Feeder ESTOP is Reset |
| 25 | Filler Feeder recovering from Fault |
| 30 | 5 second alarm sounded |
| 40 | Command servos to Home |
| | Automated Mode - Auto Run |
| 50 | If Auto is selected, infeed primed, exit ready, Servos to prime |
| 60 | Prime complete, PLC waits for Filler Ready signal |
| 70 | Filler Ready, Servo Starts to Run Automatic cycles |
| 80 | Filler Feeder ready goes away or |

TABLE 2-continued

| PLC Command Task List | |
|---|---|
| Value | Description |
| | Infeed loss prime, loop to 50 |
| | Manual Mode - Clean Mode |
| 140 | Prepare for Manual Clean Mode |
| 150 | Clean PB pressed, start dry run cycles. Puck Feed PB allows pucks to feed in. Cycle Stop or Puck Feed turns off. |
| | Manual Mode - Single Step |
| 240 | Prepare for Manual Single Step Mode |
| 250 | Single step PB pressed, complet one cycle. Puck Feed PB allows puck to fee in. Cycle Stop or Single Step turn off |

Variable Frequency Drive

The infeed conveyor motor will be controlled by an Allen Bradley 160 Variable Frequency Drive that is controlled via discrete signals.

Operation Mode Communication

The Boomerang Filler Feed system will operate in one of four selected modes listed in the following table.

The production mode is an integer code with values 0 through 5, corresponding to the table below. Mode selection is implemented with selector switches.

TABLE 3

| Operating Mode Values | |
|---|---|
| Mode | Description |
| 0 | ESTOP |
| 1 | STOP |
| 2 | Automatic |
| 3 | Manual |
| 4 | Run Out |
| 5 | |

Production Mode 0: ESTOP

STOP is for the protection and safety of the persons in the vicinity of the system, and the protection of the machine from damage.

In ESTOP the system will immediately shutdown and will not execute. ESTOP will occur when any of the system ESTOP buttons are pressed or if there is a sub-system fault such as the PLC, Servo, or VFD.

Production Mode 1: STOP

In STOP the system will perform a controlled stop of its active function; from that point it will not execute.

Production Mode 2: Automatic Mode

In Automatic Mode the system will continually execute its intermittent processes in response to communication signals to and from the bossar filler.

Production Mode 3: Step Mode

Step Mode will allow the operator to cycle the machine at a reduced speed. The machine will not cycle in response to the filler in manual mode, but will respond to the CLEAN/STEP button. A Lighted Push Button will control whether or not the puck escapement will let pucks enter indexing conveyor during STEP Mode. The Puck Feed Lighted Push Button can be used to control whether or not pucks will be fed in duming Clean Mode. When the light is on pucks will be fed in. When the light is off pucks will not be fed in. If the chute is not primed then the light will not come on and pucks will not be fed in.

Production Mode 4: Clean Mode

Clean Mode will allow the machine to operate at a reduced speed and to continuously cycle. The machine will not cycle in response to the filler in Clean Mode. A Lighted Push Button will control whether or not the puck escapement will let pucks enter indexing conveyor during Clean Mode. The STOP button will be used to stop the machine. Switching the machine to CLEAN will cause the machine to stop. Switching the machine to AUTO will also cause the machine to discontinue its continuous running but will index in response to Bossar Filler's signal. This mode is also useful because it can be used to run empty pucks through the system so that they can be weighed.

The CLEAN/STEP Push button when pressed while in Clean Mode will cause a two second alarm to sound and then will start the machine continuously indexing. The Puck Feed Lighted Push Button can be used to control whether or not pucks will be fed in duming Clean Mode. When the light is on pucks will be fed in. When the light is off pucks will not be fed in. If the chute is not primed then the light will not come on and pucks will not be fed in.

Ancilliary Interface Signals

The Boomerang Filler Feed system will communicate with the Boosar Filler and the GEBO Conveyor Supervisory Control System. The following section describes the interface signals that will be passed from each of the systems.

TABLE 4

| System Communications | |
|---|---|
| Signal | Description |
| Gebo Infeed Conveyor to Filler Feeder | |
| Infeed Primed Signal | This DH + signal is controlled by the GEBO system PLC. The bit will be energized when the Infeed Conveyor to GEBO high level and low level sensors are blocked by the presence of pucks. Discrete Signal, Relay provided by GEBO Montreal |
| Combiner infeed low prime | DH+, message on DL5 |
| Combiner is priming Filler Feeder to Gebo Infeed Conveyor | DH +, Message on DL5 |
| Index Conveyor in Motion | This relay is controlled by the Filler Feeder Servo Controller. This relay will be energized when the Filler Feeder Index Conveyor is in motion. Discrete Signal, Relay provided by Filler Feeder. This signal may be changed to DH+ |
| Puck Gate Open | This relay is controlled by the Filler Feeder Servo Controller. This relay will be energized when the Filler Feeder Lower Infeed Gate Open solenoid is energized. Discrete Signal, Relay provided by Filler Feeder. This signal may be changed to DH + |
| Speed in Puck per minute | DH +, Integer value in 0–300 Pucks Per Minute |
| Filler feeder ready | DH+ |
| Runout/Purging Filler to Filler Feeder | DH+ |
| Filler ESTOP Reset | The Filler Feeder first sends a Filler Feeder Ready for ESTOP Reset signal. In Auto mode, the Filler ESTOP Reset will attempt to reset the Filler Feeder ESTOP circuit. This signal maintains the Filler Feeder ESTOP signal in Auto Mode. Discrete Signal, Relay provided by Filler |

TABLE 4-continued

System Communications

| Signal | Description |
|---|---|
| Filler Ready Energized = Ready Not energized = Not Ready | Filler Not Ready : The Filler Running signal will turn off when Energized =Ready the Filler is not running automatic cycles, is faulted, has stopped Not energized =Not Ready or is in ESTOP. Filler Ready : The Filler starts to run when the Filler Feeder is ready, the Exit Conveyor is clear of pucks and the Filler has been started. Discrete Signal, Relay provided by Filler |
| Encoder Position | Incremental encoder used to synchronize the Filler to the Filler Feeder during automatic operation. Direct wire to Filler Feeder Servo Controller |
| Runout/Purging Filler Feeder to Filler | DH+, DL5 Message |
| Filler Feeder Ready for ESTOP Reset | This contact will close when all Filler Feeder ESTOP switches, guard switch on Infeed Conveyor, and PLC Ready to MCR Reset signal are active. Discrete Signal, Relay provided by Filler Feeder |
| Filler Feeder Ready/Filler Feeder Not Ready Energized = Ready Not energized = Not Ready | Filler Feeder Ready: Filler Feeder primed, the exit conveyor Ready clear of pucks and ready for Dropping of Pouches. (Permissive to Drop) Filler Feeder Not Ready : Filler Feeder faulted, not in Auto, not primed, not ready for Dropping of Pouches Discrete Signal, Relay provided by Filler Feeder |
| Filler Feeder Faulted | This signal will energize when the Filler Feeder detects a fault from within its own system. This is a DH + signal. |
| Gebo Exit Conveyor to Filler Feeder | |
| Exit Conveyor Ready | Exit Conveyor is fully operational, is clear of pucks and ready for pucks from the Filler Feeder Sweep Conveyor. Discrete Signal, Relay provided by GEBO Montreal |
| Filler Feeder to Gebo Exit Conveyor N/A | |

Ancilliary Sensors

Sensors that are ancilliary to the Filler Feeder sre required for proper operation of the system. All sensors are wired to the GEBO PLC and discrete signals are communicated to the Filler Feeder control system. The following table describes the sensors and their functionality.

TABLE 5

Ancillary Sensor Descriptions

| Photoeye | Description | Symbol |
|---|---|---|
| Infeed High Level Sensor | Located on the GEBO Infeed Conveyor feeding pucks to into the Infeed Chute. This sensor is located in a position to prevent excess load pressure from being applied to the Filler Feeder Lower Infeed Gate by turning off the conveyor feeding pucks to the Filler Feeder Infeed Chute. Discrete Signal, Sensor provided by GEBO Montreal. | |
| Infeed Low Level Sensor | Located on the GEBO Infeed Conveyor feeding pucks to into the Infeed Chute. This sensor is located in a position that will signal the Filler to stop picking pouches from the magazine due to an inadequate puck supply at the Filler Infeed Conveyor system. Discrete Signal, Sensor provided by GEBO Montreal | |
| Exit Clear Sensor | Located on the GEBO Exit Conveyor and informs the Filler Feeder that it is fully operational, is clear of pucks and ready for pucks from the Filler Feeder Sweep Conveyor. Discrete Signal, Sensor provided by GEBO Montreal | |

Servo Controllers

There are two servo controlled conveyors, the Indexing Conveyor and the Exit Sweep Conveyor. The home sequence for the conveyor pair will follow the priority set in the following table. The Exit Sweep conveyor will home in the forward direction and will sweep across the Indexing Conveyor at least once. If the Indexing conveyor is on its home prox then it will move forward off of its home prox and home in the reverse direction. If the Indexing Conveyor is off of its home prox then it will home in the reverse direction.

TABLE 6

Servo Home Sequence Priority Table

| Index Home Prox | Sweep Home Prix | Home Move First |
|---|---|---|
| ON | ON | Exit Sweep Conveyor |
| ON | OFF | Exit Sweep Conveyor |
| OFF | ON | Index Conveyor |
| OFF | OFF | Exit Sweep Conveyor |

Indexing Conveyor

The basic function of the Indexing Conveyor is to Index the rows of pucks so that pouches can be dropped into the pucks simultaneous to empty pucks feeding onto the conveyor and filled pucks being swept off of the conveyor.

The index distance is 100 mm. The index move will occur in less than 500 ms. The limiting factor for this index move is the tendency of the pucks with pouches to tip under conditions of high acceleration or deceleration. Physically the the conveyor is constructucted that a 48 tooth pully drives the timing belt that has a pitch of 10 mm. The belt is driven by a Pacific Scientific brushless servomotor S33HNNA powered by a Pacific Scientific SC952. There are 4096 Encoder Counts per revolution of the motor and the gear box is 30: 1. It is important to note that there is an integer number (25600) of Encoder Counts per machine cycle.

The Indexing Conveyor will index in response to the pouches being released into the pucks.

A Sweep Clear Sensor will be used to verify that there are no pucks on the Indexing Conveyor before it indexes. An Index Prox will be used to mark the location that the Sweep Clear Sensor must be clear so that Pucks cannot be indexed into the Sweep Conveyor mechanism. The hardwired logic for the Index Conveyor OverTravel Detection will is described in the following table.

TABLE 7

Index Conveyor Over Travel Detection

| Index Prox | Sweep Clear Sensor | Result |
|---|---|---|
| ON | ON | Over Travel Condition |
| ON | OFF | Normal |
| OFF | ON | Normal |
| OFF | OFF | Normal |

Exit Sweep

The basic function of the Exit Sweep Conveyor is to remove a row of filled pucks off of the Indexing Conveyor onto a takeaway coveyor. To clear the filled pucks off of the Indexing Conveyor, the filled pucks must travel at least 300 mm. The remaining 200 mm will be used for deceleration.

The sweep distance is 500 mm. The index move will occur in less than 900 ms. The limiting factor for this sweep move is the tendency of the pucks with pouches to tip under conditions of high acceleration. Physically the conveyor is constructed that a 48 tooth pulley drives the timing belt that has a pitch of 10 mm. The belt is driven by a Pacific Scientific brushless servomotor S33HNNA powered by a Pacific Scientific SC952. There are 4096 Encoder Counts per revolution of the motor and the gear box is 15: 1. It is important to note that there is an integer number (64000) of Encoder Counts per machine cycle.

Filler Feeder Priming Sequence

| State | Name | Conditions | Actions |
|---|---|---|---|
| 0 | Begin Prime Sequence | Filler Feed Homed<br>Filler Feed Re-sync<br>Filler Feed at Stop<br>Lower Gate is Closed<br>Index Conveyor is Stopped in Position | Extend Dampener |
| 1 | Release Dampener | Dampener Extended | Release Dampener |
| 2 | Open Gate | Puck Chute Primed | Puck Jam Fault Detect<br>Open Gate |
| 3 | Close Gate | First Puck Sensor Blocked<br>Last Puck Sensor Blocked<br>Dampener Not Extended | Puck Jam Fault Detect<br>Close Gate |
| 4 | Index Conveyor | Gate Closed<br>Sweep in Ready Position<br>Down Stream Ready | Begin Index |
| 5 | Sweep Conveyor | Index move complete<br>Down Stream Ready | Begin Sweep<br>Extend Dampener |
| 6 | Release Dampener | Dampener Extended | Release Dampener |
| 7 | Open Gate | Puck Chute Primed | Puck Jam Fault Detect<br>Open Gate |
| 8 | Close Gate | First Puck Sensor Blocked<br>Last Puck Sensor Blocked<br>Dampener Not Extended | Puck Jam Fault Detected |

-continued

Filler Feeder Priming Sequence

| State | Name | Conditions | Actions |
|---|---|---|---|
| 9 | End Prime Sequence | Gate Closed | Empty pucks are fed into puck load position |

Filler Feeder Running Sequence

| State | Name | Conditions | Actions |
|---|---|---|---|
| 0 | Begin Run Cycle Sequence | Filler Feed Ready<br>Filler Ready<br>Lower Gate is Closed<br>Index Conveyor is Stopped in Position | |
| 4 | Index Conveyor | Gate Closed<br>Sweep is in Position<br>Sweep is Clear of Pucks<br>Down Stream Ready<br>Master Encoder in Pouch Drop Position | Begin Index<br>Index CR on |
| 5 | Detect Pouches | Mater Encoder ib Pouch Reject Position | Pouch Present set True/False |
| 6 | Release Dampener | Dampener Extended | Release Dampener |
| 7 | Open Gate | Pouches were present<br>Puck Chute Primed | Puck Jam Fault Detect<br>Open Gate |
| 8 | Close Gate | First Puck Sensor Blocked<br>Last Puck Sensor Blocked<br>Dampener Not Extended<br>Pouches were not present | Puck Jam Fault Detect<br>Close Gate |
| 9 | End Run Cycle Sequence | Gate Closed | Cycle complete |

Filler Feeder Mode Chart

| Mode | Name | Conditions | Actions |
|---|---|---|---|
| 0 | Filler Feeder Estopped | ESTOP Buttons Pressed<br>PLC is not ready | |
| 1 | Filler Feeder ESTOP clear | PLC is ready<br>ESTOP buttons are up<br>All Faults Clear | PLC Ready CR pulls in<br>Circuit Control Relay pulls in |
| 2 | Filler Feeder Automatic Reset | Filler Feeder ESTOP clear<br>Pouch Filler is Reset | Filler Feeder MCR pulls in |
| 3 | Filler Feeder Homing | Filler Feeder MCR pulled in<br>Down stream Ready | Motion warning signal is sounded<br>Chute gate is closed<br>Servos perform homing moves |
| 4 | Filler Feeder Homed | Home moves complete | Filler Feeder needs to be Primed |

-continued

Filler Feeder Mode Chart

| Mode | Name | Conditions | Actions |
|---|---|---|---|
| 5 | Filler Feeder Priming | Filler Feeder Homed | Empty pucks are fed into puck load position |
| | | Puck Chute Primed | |
| | | Down Stream Ready | |
| 6 | Filler Feeder Ready | Filler Feeder Primed | Filler Feeder Ready CR pulls in |
| | | Puck Chute Primed | |
| | | Down Stream Ready | |
| | | Filler Feeder Stopped | |
| 7 | Filler Feeder Running | Filler Feeder Ready | Filler Feeder Running in Automatic |
| | | Pouch Filler Ready | |
| 8 | Filler Feeder Purge | Filler Feeder Running | Filler Feeder Ready CR falls out |
| | | Pouch Filler not Ready | Filler Feeder Purges pouches out of system |
| | | Filler Feeder has filled pucks | |
| 9a | Filler Feeder Re-sync | Filler Feeder Running | Filler Feeder needs to be Primed (5) |
| | | Pouch Filler Ready | |
| 9b | Filler Feeder at Stop | Filler Feeder Purge Sequence completed | Filler Feeder needs to be Primed (5) |
| 10 | Filler Feeder Stopped | Filler Feeder Stop PBPressed | Filler Feeder Ready CR falls out |
| | | Down Stream Not Ready | |
| | | Filler Feeder Stop fault | |

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved conveyer system for receiving, orienting and conveying pouches adapted to receive fluid material therein comprising, in combination:

a plurality of pucks, each puck having a cylindrical lower extent with a rectangular recess extending upwardly from the lower surface thereof and extending across the entire diameter thereof and having an upstanding cylindrical wall with generally V-shaped openings formed therein for receiving and supporting a pouch;

a powered indexing conveyer including a belt in a closed loop configuration supported by an idler roller at one end and with a drive roller at the other end with a motor to drive the rollers and belt in a step and repeat operation, the exterior surface of the belt being formed with a plurality of spaced plates extending transversely thereacross with an upstanding rectilinear cleat on each plate to receive the recesses of a set of four pucks thereacross, the indexing conveyer belt being in a generally horizontal orientation with an input end and an output end;

a powered infeed conveyer having a generally horizontal spine alignable with the cleat at the input end of the indexing conveyor adapted to receive and orient pucks from the infeed conveyer to the indexing conveyer and with an overhead guide rail located immediately above the upper edge of the pucks to preclude tipping of the pucks, the infeed conveyer having an input end and an output end adjacent to the input end of the indexing conveyer with an escapement mechanism therebetween to control the quantity of pucks transferred from the infeed conveyer to the indexing conveyor, the infeed conveyor including a belt in a closed loop configuration supported by an idler roller at one end and a drive roller at the other end with a motor to drive the rollers and belt and pucks thereabove in a horizontal path of movement to the indexing conveyor;

a filler infeed chute having an elevated input end and a lower output end adjacent to the input end of the infeed conveyor and with a lower spine to receive and orient pucks as they are fed by gravity down the infeed chute, the infeed chute also having an overhead rail located immediately above the upper edge of the pucks to preclude the tipping thereof;

a filler exit conveyor having an input end and an output end, the input end being located in operative proximity to the output end of the indexing conveyor, the filler exit conveyor including a conveyor belt supported by an idler roller and a drive roller with a motor to drive the rollers and belt, the rollers of the exit conveyor being mounted for rotation about the vertical axes with the belt having a vertical path of travel adjacent to the pucks at the output end of the indexing conveyor, the conveyor belt having a plurality of outwardly extending fingers adapted to contact and move the set of four pucks at the output end of the indexing conveyor and to move them to the input end of the exit conveyor;

feeding mechanisms located over the indexing conveyor adapted to deliver sets of four pouches downwardly into the recesses within a set of pucks laterally aligned on the indexing conveyor; and control mechanisms to operate the motors in a continuous and automatic cycle of operation.

2. A conveyer system for receiving, orienting and conveying pouches:

a plurality of pucks, each puck having a lower extent with a recess extending upwardly from the lower surface thereof and having an upstanding cylindrical wall;

an indexing conveyer including a belt in a closed loop configuration supported by an idler roller at one end and with a drive roller at the other end with a motor to drive the rollers and belt in a step and repeat operation, the exterior surface of the belt being formed with a plurality of plates with a cleat on each plate to receive the recesses of a plurality of pucks thereacross, the indexing conveyer belt having an input end and an output end;

an infeed conveyer having a spine alignable with the cleat at the input end of the indexing conveyor adapted to receive and orient pucks from the infeed conveyer to the indexing conveyer, the infeed conveyer having an input end and an output end adjacent to the input end of the indexing conveyer, the infeed conveyor including a belt in a closed loop configuration supported by an idler roller at one end and a drive roller at the other end with a motor to drive the rollers and belt and pucks thereabove to the indexing conveyor; and a filler exit conveyor having an input end and an output end, the input end being located in operative proximity to the output end of the indexing conveyor, the filler exit conveyor including a conveyor belt supported by an idler roller and a drive roller with a motor to drive the rollers and belt.

3. The system as set forth in claim 2 wherein the rollers of the exit conveyor are mounted for rotation about the vertical axes with the belt having a vertical path of travel adjacent to the pucks at the output end of the indexing conveyor, the conveyor belt having a plurality of outwardly extending fingers adapted to contact and move the set of four pucks at the output end of the indexing conveyor.

4. The system as set forth in claim 2 wherein the feeding mechanisms are located over the indexing conveyor adapted to deliver sets of four pouches downwardly into the recesses within a set of pucks laterally aligned on the indexing conveyor.

5. The system as set forth in claim 2 wherein control mechanisms operate the motors in a continuous and automatic cycle of operation.

* * * * *